US008653398B2

(12) United States Patent
Gentsch

(10) Patent No.: US 8,653,398 B2
(45) Date of Patent: Feb. 18, 2014

(54) ELECTRICAL DEVICE WITH A MULTI-CHAMBER HOUSING

(75) Inventor: Dietmar Gentsch, Ratingen (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/446,230

(22) Filed: Apr. 13, 2012

(65) Prior Publication Data

US 2013/0008765 A1 Jan. 10, 2013

Related U.S. Application Data

(63) Continuation of application No. PCT/EP2010/006286, filed on Oct. 14, 2010.

(30) Foreign Application Priority Data

Oct. 14, 2009 (EP) ..... 09012964

(51) Int. Cl.
*H01H 33/66* (2006.01)

(52) U.S. Cl.
USPC ..... 218/154; 218/118

(58) Field of Classification Search
USPC ..... 218/152–154, 118–120
See application file for complete search history.

(56) References Cited

U.S. PATENT DOCUMENTS

| | | | | |
|---|---|---|---|---|
| 4,434,331 A | | 2/1984 | Sakuma et al. | |
| 5,486,662 A | * | 1/1996 | Takiishi | 200/50.27 |
| 5,539,168 A | * | 7/1996 | Linzenich | 200/303 |
| 6,130,594 A | | 10/2000 | Morant et al. | |
| 6,541,727 B2 | * | 4/2003 | Beck et al. | 218/140 |
| 6,930,271 B1 | * | 8/2005 | Palmieri et al. | 218/154 |
| 2008/0142485 A1 | | 6/2008 | Gentsch et al. | |

FOREIGN PATENT DOCUMENTS

| | | | |
|---|---|---|---|
| DE | 2244825 | A1 | 3/1974 |
| DE | 8028797 | U1 | 2/1981 |
| EP | 0898780 | B1 | 4/2000 |
| EP | 1496535 | A1 | 1/2005 |
| JP | 56-97926 | A | 8/1981 |
| JP | 57-101446 | U | 6/1982 |

OTHER PUBLICATIONS

International Search Report (PCT/ISA/210) issued on Nov. 15, 2010, by European Patent Office as the International Searching Authority for International Application No. PCT/EP2010/006286.
Written Opinion (PCT/ISA/237) issued on Nov. 15, 2010, by European Patent Office as the International Searching Authority for International Application No. PCT/EP2010/006286.

* cited by examiner

*Primary Examiner* — Truc Nguyen
(74) *Attorney, Agent, or Firm* — Buchanan Ingersoll & Rooney PC

(57) ABSTRACT

An electrical circuit-breaker device includes at least one pole part with a respective housing arrangement for encapsulating an interrupter insert having two corresponding electrical contacts, and an adjacent actuator part for mechanically moving one of the electrical contacts via an intermediate operating mechanism. A method of producing the device includes molding a multi-chamber housing by injection molding of plastic material with a first chamber and at least one further chamber, assembling the actuator part in the first chamber and the at least one respective interrupter insert in its own further chamber, and assembling the intermediate operating mechanism through an assembly opening in a common side wall between the first chamber and the at least one further chamber.

15 Claims, 1 Drawing Sheet

ELECTRICAL DEVICE WITH A MULTI-CHAMBER HOUSING

RELATED APPLICATIONS

This application claims priority as a continuation application under 35 U.S.C. §120 to PCT/EP2010/06286, which was filed as an International Application on Oct. 14, 2010 designating the U.S., and which claims priority to European Application 09012964.4 filed in Europe on Oct. 14, 2009. The entire contents of these applications are hereby incorporated by reference in their entireties.

FIELD

The present disclosure relates to a method for producing an electrical circuit-breaker device including at least one pole part with a respective housing arrangement for encapsulating an interrupter insert having two corresponding electrical contacts, and an adjacent actuator part for mechanically moving one of the electrical contacts via an intermediate operating mechanism. Furthermore, the present disclosure relates to a multi-chamber housing for such a medium-voltage or high-voltage circuit-breaker device.

Vacuum circuit-breakers improve the interruption process substantially through reduced contact travel, reduced contact velocity (compared to former minimum oil type breakers) and small masses of moving the electrical contacts. Accordingly, the vacuum circuit breaker requires a significantly smaller, lower energy actuator part with significantly reduced wear, which is usually designed as an electromagnetic device with at least one electrical coil surrounded by a ferromagnetic joke assembly which corresponds with a movable ferromagnetic armature in order to generate a suitable mechanical actuating force by electrical energy.

BACKGROUND INFORMATION

EP 0 898 780 B1 discloses a magnetically actuated circuit breaker for medium voltage applications in the range between 1 and 72 kV of a high current level. A single electromagnetic actuator drives a common jackshaft. This jackshaft internally couples the actuator force to the moving electrical contacts of each vacuum interrupter on all three poles through insulated push rods.

The electromagnetic actuator consists of a bistable magnet system, in which switching the armature to the relative positions are affected by the magnetic field of an electrically excited coil. The magnetic latching required holds contacts together during faults. A permanent magnet arrangement holds the ferromagnetic armature in one of the two limit positions corresponding to ON and OFF position respectively. In the ON position, the electrical contacts of the vacuum interrupter are opened; in the OFF position, these electrical contacts are closed.

All main parts of the known circuit breaker need their own housing, especially the actuator part, the three pole parts and the operating mechanism, including the jackshaft. During the manufacturing of the circuit breaker, all these housings have to be assembled one to another by screwing. This construction principle causes big geometrical dimensions of the circuit breaker device.

SUMMARY

An exemplary embodiment of the present disclosure provides a method of producing an electrical circuit-breaker device, which includes at least one pole part with a respective housing arrangement for encapsulating an interrupter insert having two corresponding electrical contacts, and an adjacent actuator part for mechanically moving one of the electrical contacts via an intermediate operating mechanism. The exemplary method includes molding a multi-chamber housing by injection molding of plastic material with a first chamber and at least one further chamber, assembling the actuator part in the first chamber and the at least one respective interrupter insert in its own further chamber, and assembling the intermediate operating mechanism through an assembly opening in a common side wall between the first chamber and the at least one further chamber.

An exemplary embodiment of the present disclosure provides a multi-chamber housing for a medium-voltage circuit-breaker device, which includes a pole part and an actuator part made of plastic material by injection molding, and a common side wall between the pole part and an actuator part. The common side wall has at least one assembly opening for an operating mechanism in a form of a jackshaft arrangement.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
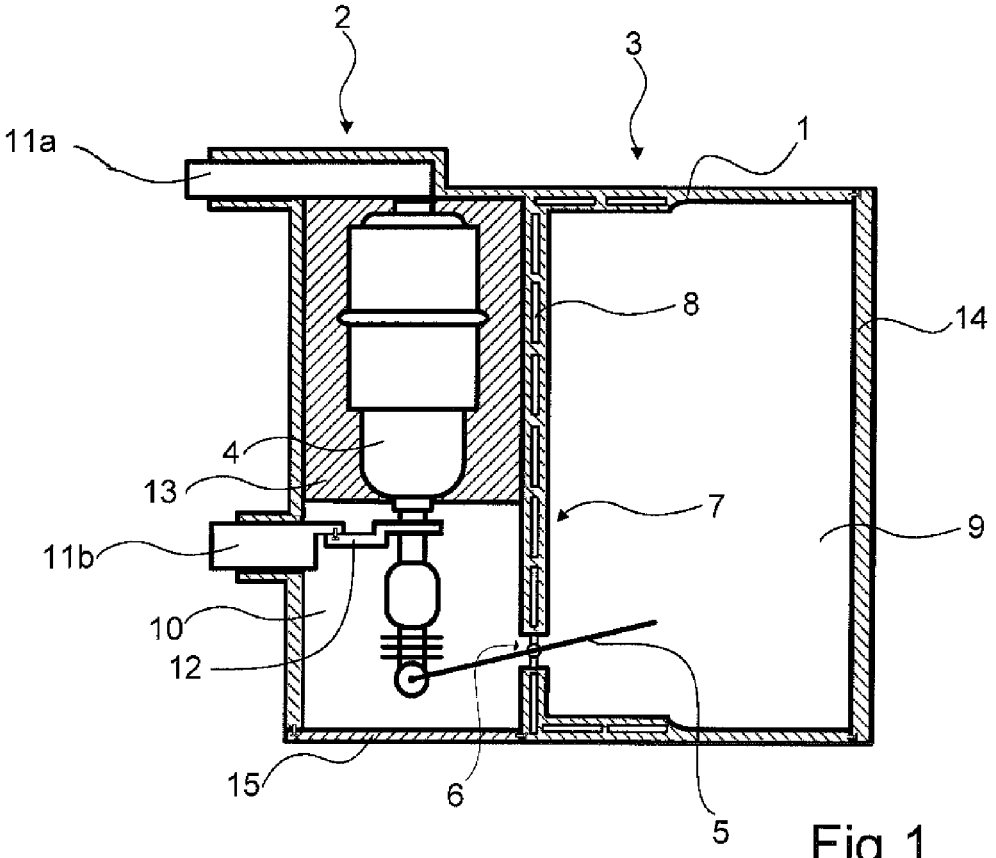
FIG. 1 is a schematic side view of a medium-voltage circuit-breaker device with a multi-chamber housing according to an exemplary embodiment of the present disclosure.

Exemplary embodiments of the present disclosure provide an electrical circuit breaker and a method for producing such a device which is easy to assemble and which is characterized by a compact design.

According to an exemplary embodiment of the present disclosure, a multi-chamber housing for the circuit breaker device includes at least one pole part and an actuator part made of plastic material by injection molding. A common sidewall is provided between the pole part and an actuator part with at least one assembly opening for the operating mechanism in the form of a pivotally attached jackshaft arrangement.

According to an exemplary embodiment of the present disclosure, the multi-chamber housing avoids separate housings for the pole part(s), the actuator part and the operating mechanism. In known techniques, these housings have to be assembled one to another in order to form the circuit breaker arrangement. In contrast, the present disclosure ensures a compact construction with only a few parts.

The production of a circuit breaker including at least one pole part with a respective housing arrangement for encapsulating an interrupter insert and an adjacent actuator part for mechanically moving one of the electrical contacts via an intermediate operating mechanism can include the following production steps: (i) molding a multi-chamber housing by injection molding of plastic material with a first chamber and at least one further chamber; (ii) assembling the actuator part in the first chamber and the at least one respective interrupter insert in its own further chamber; and assembling the intermediate operating mechanism through an assembly opening in a common side wall between the first chamber and the at least one further chamber.

Only a few production steps are necessary in order to manufacture the circuit breaker according to the present disclosure. The number of further chambers depends on the number of pole parts of the circuit breaker. For example, three pole parts are generally needed for a medium voltage circuit breaker of a power grid.

According to an exemplary embodiment of the present disclosure, two electrical connectors are molded in the multi-chamber housing of the pole part for electrically connecting the inner electrical contacts of the interrupter insert. These molded electrical connectors can be composed of copper material which is surrounded by the plastic material. On both front sides of the molded electrical connectors, an electrical cable or the like is attachable thereon.

In accordance with an exemplary embodiment, the multi-chamber housing can be molded with multiple layers of thermoplastic material. The multiple layer construction ensures a high mechanical strange of the housing. Nevertheless, a single layer construction might be sufficient in many applications.

In order to further increase the mechanical strange of the multi-chamber housing, an additional enforcement plate can be molded in the plastic material. In accordance with an exemplary embodiment, the enforcement plate is molded in a common side wall between the first chamber in the at least one further chamber of the housing. If necessary, the enforcement plate could also be inserted in adjacent wall portions of the common side wall. A suitable enforcement plate can be composed of a perforated metal sheet.

In accordance with an exemplary embodiment of the present disclosure, the first chamber and/or any further chamber of the actuator part and the pole part(s) respectively is closed by removable covers. The covers are placed on specific wall sections of the multi-chamber housing in order to provide an access to the respective chamber. A front cover can be placed on the first chamber for the actuator part in order to reach an easy access. Removable bottom covers can be placed on the lower side of the multi-chamber housing in order to ensure an access to the movable electrical contact and its operating mechanism. In accordance with an exemplary embodiment, all covers on the multi-chamber housing can be attached by several screws or by a clip mechanism in order to ensure a quick remove of the cover for maintenance purposes.

According to an exemplary embodiment of the present disclosure, the interrupter insert is assembled in its own chamber housing by screwing. However, it is also possible to place the interrupter insert in a casting mold before injection molding the multi-chamber housing in order to mold the interrupter insert in the multi-chamber housing.

The foregoing and other aspects of the disclosure will become apparent following the detailed description of the present disclosure when considered in conjunction with the appended drawings.

The medium-voltage circuit-breaker as shown in FIG. 1 principally includes a pole part 2 and an actuator part 3. The pole part 2 includes a vacuum interrupter insert 4 having two corresponding electrical contacts. An axial movable electrical contact of both contacts is operated by the actuator part 3 via an intermediate operating mechanism 5. The operating mechanism 5 is designed as a jackshaft arrangement extending through an opening 6 in a common side wall 7 of the multi-chamber housing 1.

The common side wall 7 is provided between the pole part 2 and the adjacent actuator part 3 and includes a molded enforcement plate 8. In accordance with an exemplary embodiment, the enforcement plate 8 is designed as a perforated metal sheet for increasing the mechanical strength of the multi-chamber housing 1. The multi-chamber housing 1 can include multiple layers of injection molded thermoplastic material.

A multi-chamber housing 1 includes a first chamber 9 for accommodating an electromagnetic actuator for moving the respective electrical contacts of the adjacent interrupter insert 4 of the pole part 2. A further chamber 10 is provided for accommodating the interrupter insert 4. During the molding process, two electrical connectors 11*a* and 11*b* are molded in the multi-chamber housing 1. Both electrical connectors 11*a* and 11*b* correspond with respective inner electrical contacts of the interrupter insert 4.

In order to ensure an electrical connection between the lower electrical contact which is movably attached to the operating mechanism 5, a flexible connector 12 is provided between the lower electrical contact of the interrupter insert 4 and the outer electrical connector 11*b*. The jackshaft part of the operating mechanism 5 is pivotally attached in the area of the opening 6 of the common side wall 7 between the first chamber 9 and the further chamber 10 in order to ensure a pivoting movement of the jackshaft part of the operating mechanism 5.

According to an exemplary embodiment, the vacuum interrupter 4 is assembled in its chamber 10 after molding the multi-chamber housing 1. The vacuum interrupter insert 4 is assembled in the further chamber 10 of the pole part 2 by screwing in the chamber 10 on a threaded bolt of the electrical connector 11*a*. The diameter of the principally cylindrical vacuum interrupter 4 is adapted to the inner surface of the further chamber 10 in a way that an intermediate gap is provided which is filled with a potting material 13 afterwards. The potting material 13 is filled under normal pressure in the gap in order to form an additional compensating layer around the vacuum interrupter insert 4.

The multi-chamber 1 also includes a removable front cover 14 on the first chamber 9 of the actuator part 3. On the lower side of the multi-chamber housing 1, a removable bottom cover 15 is provided on the further chamber 10 for accommodating the vacuum interrupter insert 4. All covers 14 and 15 are attached on the multi-chamber housing 1 by a suitable number of screws.

Figure 2:
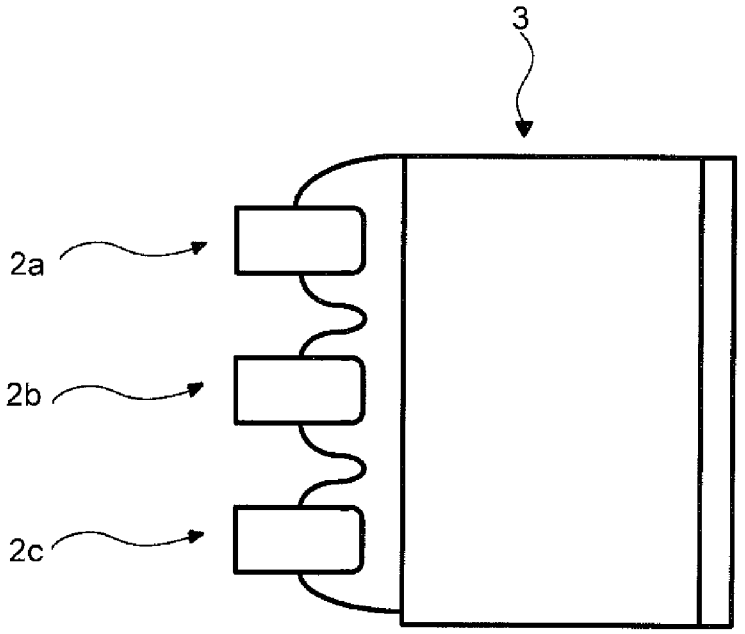
FIG. 2 is a top view of the device of FIG. 1.

As shown in FIG. 2, the circuit breaker includes three pole parts 2*a*, 2*b* and 2*c* in total. The three pole parts 2*a*-2*c* are intended for a three-phase circuit breaker. All pole parts 2*a*-2*c* are operated by a common electromagnetic actuator 3 as described above.

The present disclosure is not limited by the exemplary embodiments described with respect to the drawings which are presented as an example only. The disclosed embodiments can be modified in various ways within the scope of protection defined by the following patent claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE LIST

1 multi-chamber housing
2 pole part
3 actuator part
4 interrupter insert

5 operating mechanism
6 assembly opening
7 common side wall
8 enforcement plate
9 first chamber
10 further chamber
11 electrical connector
12 flexible connector
13 potting material
14 front cover
15 bottom cover

What is claimed is:

1. A method of producing an electrical circuit-breaker device including at least one pole part with a respective housing arrangement for encapsulating an interrupter insert having two corresponding electrical contacts, and an adjacent actuator part for mechanically moving one of the electrical contacts via an intermediate operating mechanism, the method comprising:

molding a multi-chamber housing by injection molding of plastic material with a first chamber and at least one further chamber;

assembling the actuator part in the first chamber and the at least one respective interrupter insert in its own further chamber;

assembling the intermediate operating mechanism through an assembly opening in a common side wall between the first chamber and the at least one further chamber; and molding an enforcement plate in the common side wall between the first chamber and the at least one further chamber.

2. The method according to claim 1, comprising:

molding two electrical connectors in the multi-chamber housing of the pole part for electrically connecting inner electrical contacts of the interrupter insert.

3. The method according to claim 1, comprising:

molding the multi-chamber housing with multiple layers of thermoplastic material.

4. The method according to claim 1, comprising:

assembling at least one vacuum interrupter insert in its own further chamber after molding the multi-chamber housing.

5. The method according to claim 4, wherein the at least one vacuum interrupter insert is placed in a casting mold before molding the multi-chamber housing to mold the at least one vacuum interrupter insert in the multi-chamber housing.

6. A multi-chamber housing for a medium-voltage circuit-breaker device, comprising:

a pole part and an actuator part made of plastic material by injection molding; and a common side wall between the pole part and the actuator part, the common side wall having at least one assembly opening for an operating mechanism in a form of a jackshaft arrangement, wherein the common side wall and adjacent wall portions comprise an inner enforcement plate formed therein.

7. The multi-chamber housing according to claim 6, comprising:

a removable front cover on a first chamber of the actuator part.

8. The multi-chamber housing according to claim 6, comprising:

a removable bottom cover on each further chamber of the pole part, respectively.

9. The multi-chamber housing according to claim 7, wherein the front cover and a bottom cover are attached on the multi-chamber housing by several screws.

10. A medium-voltage circuit-breaker comprising at least one pole part and an actuator part accommodated in a multi-chamber housing according to claim 6.

11. The multi-chamber housing according to claim 8, wherein the front cover and a bottom cover are attached on the multi-chamber housing by several screws.

12. A medium-voltage circuit-breaker comprising at least one pole part and an actuator part accommodated in a multi-chamber housing according to claim 7.

13. A medium-voltage circuit-breaker comprising at least one pole part and an actuator part accommodated in a multi-chamber housing according to claim 8.

14. A medium-voltage circuit-breaker comprising at least one pole part and an actuator part accommodated in a multi-chamber housing according to claim 9.

15. A medium-voltage circuit-breaker comprising at least one pole part and an actuator part accommodated in a multi-chamber housing according to claim 11.

* * * * *